US005085434A

United States Patent [19]

Soto, II

[11] Patent Number: 5,085,434

[45] Date of Patent: Feb. 4, 1992

[54] MAGNETIC INDICATOR DEVICE

[76] Inventor: Luis A. Soto, II, 5702 Braesheather, Houston, Tex. 77096

[21] Appl. No.: 607,736

[22] Filed: Nov. 1, 1990

[51] Int. Cl.[5] ..... A63F 5/04; A63H 33/26

[52] U.S. Cl. ..... 273/138 A; 273/141 A; 446/131

[58] Field of Search ..... 273/141 A, 141 R, 138 A, 273/1 GD, 1 M; 446/129, 131, 133

[56] References Cited

U.S. PATENT DOCUMENTS

| | | | |
|---|---|---|---|
| 1,093,577 | 4/1914 | Palmer | 273/161 |
| 3,478,466 | 11/1969 | Conner | 273/456 |
| 3,707,290 | 12/1972 | Birnkrant | 273/141 A |
| 3,764,145 | 10/1973 | Schrafft | 273/131 |
| 4,091,565 | 5/1978 | Sheehan | 46/238 |
| 4,211,414 | 7/1980 | Moodt | 273/141 A |
| 4,250,659 | 2/1981 | Ishiguro | 273/456 |
| 4,690,409 | 9/1987 | Scalia | 273/299 |
| 4,690,657 | 9/1987 | Lodrick | 273/141 A |

*Primary Examiner*—Benjamin Layno

*Attorney, Agent, or Firm*—Harrison & Egbert

[57] ABSTRACT

An apparatus having a base with a plurality of magnetic members attached thereto, an arm connected to the base and extending upwardly above the base, and a rigid rod articulated to one end of the arm. The rigid rod has a magnet attached to the end of the rod opposite the arm. This magnet is interactive with the magnetic members of the base. The magnetic members are arranged in a circular pattern within the base. Each of the plurality of magnetic members extends upwardly in the base such that it has a common magnetic pole adjacent an upper surface of the base. A reverse polarity magnet is fastened within the base generally central of the circular pattern of the plurality of magnetic members. The arm has a ball joint that allows the rigid rod to be articulated to the arm. A magnet is affixed to the end of the dowel rod and has a polarity opposite the polarity of the plurality of magnetic members. Indicator pads are provided on the surface of the base adjacent to the plurality of magnetic members.

16 Claims, 3 Drawing Sheets

MAGNETIC INDICATOR DEVICE

TECHNICAL FIELD

The present invention relates to indicator devices. More particularly, the present invention relates to magnetic devices that can be used as toys, decision makers, or random number generators.

BACKGROUND ART

For the most part, prior art amusement devices having a pointer for the random selection of numbers or other answers and directions have been of the spinner type, in which the pointer is mounted for rotation about an axis extending through the center of the pointer and perpendicular to the plane of movement thereof. Rotation of prior art pointers was usually obtained by the direct application of physical energy with motion of the pointer being in a regular path.

In many games, a die is used to determine the reference number. Dice are quite common and have been used in games since ancient Roman times. However, it is often exciting to use other devices in place of the ordinary die. For the purposes of amusement devices, any apparatus that is capable of generating a random number between one and six can be used as a substitute die.

Various U.S. patents have described magnetically actuated amusement devices in the past. These patents have related to a variety of pointers and decision making tools.

U.S. Pat. No. 4,211,414, issued on July 8, 1980, to J. E. Lodrick, Sr., is an amusement device that has a first magnet that is freely movable in a base and a second magnet that is suspended from a tether and a support arm attached to the base. These are arranged such that the second magnet is influenced by the movement of the first magnet. The repulsive interaction between the two magnets maintains the second magnetic member essentially parallel to the base and perpendicular to the tether. The second magnetic member is freely rotatable about the point of attachment to the tether such that movements of the first magnetic member cause corresponding changes in the rotational orientation of the second magnetic member.

U.S. Pat. No. 3,707,290, issued on Dec. 26, 1972, to M. Birnkrant is another type of amusement device in which a pointer is suspended above an answer board. The pointer is suspended by a thread. A permanent magnet is positioned immediately below the answer board and cooperates with a permanent magnet mounted to the pointer such that the flux fields of the magnets interact. The pointer is repelled so as to be directed to toward the periphery of the answer board. The edges of the permanent magnet are notched so that the flux lines are not uniformly distributed. The pointer will eventually seek an equilibrium position.

U.S. Pat. No. 4,211,414, issued on July 8, 198O, to J. C. Moodt describes a "wheedle wheel game apparatus". The base of this device is printed with a number of markings to indicate various activities. A pointer is rotatably attached to the base. The magnets which are disposed in the base and in the pointer serve to attract and repel the pointer to select a predetermined category of activities. In this particular invention, the desired activities are represented by an attractive magnet. The undesired activities are represented by a repulsive magnet. As such, the pointer will always choose one of the desired activities.

An older patent, U.S. Pat. No. 1,093,577, issued on Apr. 14, 1914, to H. B. Palmer, describes a game apparatus in which a witch figurine is attached to closely arranged repelling magnet. The witch has a stick in her hand that includes another magnet which points outwardly. The rotation of the witch will eventually point to certain decision making circles.

It is an object of the present invention to provide an indicator device which can generate random numbers between one and six.

It is another object of the present invention to provide an amusement device which assists in the decision making process.

It is a further object of the present invention to provide an indicator device that provides a great deal of motion and movement prior to decision making.

It is still a further object of the present invention to provide an indicator device that is relatively inexpensive to manufacture and easy to operate.

These and other objects and advantages of the present invention will become apparent from a reading of the attached specification and appended claims.

SUMMARY OF THE INVENTION

The present invention is an apparatus that comprises a base having a plurality of magnetic members attached thereto, an arm which is connected to the base and extends upwardly above the base, and a rigid rod that is articulated at one end to the arm. The rigid rod has a magnet attached at the other end in close proximity to the plurality of magnets in the base. The magnet on the rigid arm is interactive with the magnetic members of the base.

The plurality of magnetic members are arranged in a circular pattern within the base. Each of these plurality of magnetic members is spaced by an equal distance from an adjacent magnetic member and each has an equal radius from a center point. Each of the magnetic members has a cylindrical shape. As such, each of the magnetic members is affixed within a hole on the interior of the base. As arranged, each of the magnetic members has the same magnetic pole in the end adjacent to the top surface of the base. This end of the magnetic members is positioned approximately one-eighth of an inch from the upper surface of the base. As such, each of the magnetic members will have a north magnetic pole adjacent to top surface of the base or each of the magnetic members will have a south pole adjacent to the top surface of the base.

In the preferred embodiment of the present invention, there are six magnetic members arranged in the base. Each of the magnetic members would, in this embodiment, correspond to each of the numbers on a die. In an alternative embodiment of the present invention, a reverse polarity magnetic member is fastened within the base of the center of the circular pattern of magnetic members. This reverse polarity magnetic member has a pole of opposite polarity adjacent to the upper surface of the base.

The arm of the present invention has one end that is removably fastened to the base. The rigid rod is articulated to the other end of the arm, and is positioned generally above the plurality of magnetic members in the base. Specifically, the rigid rod comprises a dowel rod that is connected by a ball joint to the portion of the arm positioned above the base. The rigid rod extends downwardly from this arm. A magnet is affixed to the other end of the dowel rod. As used, this magnet is interposed between the plurality of magnetic members and the dowel rod. The magnet on the dowel rod has a polarity that matches the polarity of the magnetic members adjacent to the upper surface of the base.

A plurality of indicator pads are fastened to the top surface of the base. Each of these indicator pads is aligned with a corresponding magnetic member within the base. On each of these indicator pads, there can be placed either decision making information or numbers. For example, if there are six magnetic members within the base, then the indicator pads can have the numbers one through six marked thereon so that the apparatus of the present invention can act as a substitute die.

DETAILED DESCRIPTION OF THE INVENTION

Figure 1:
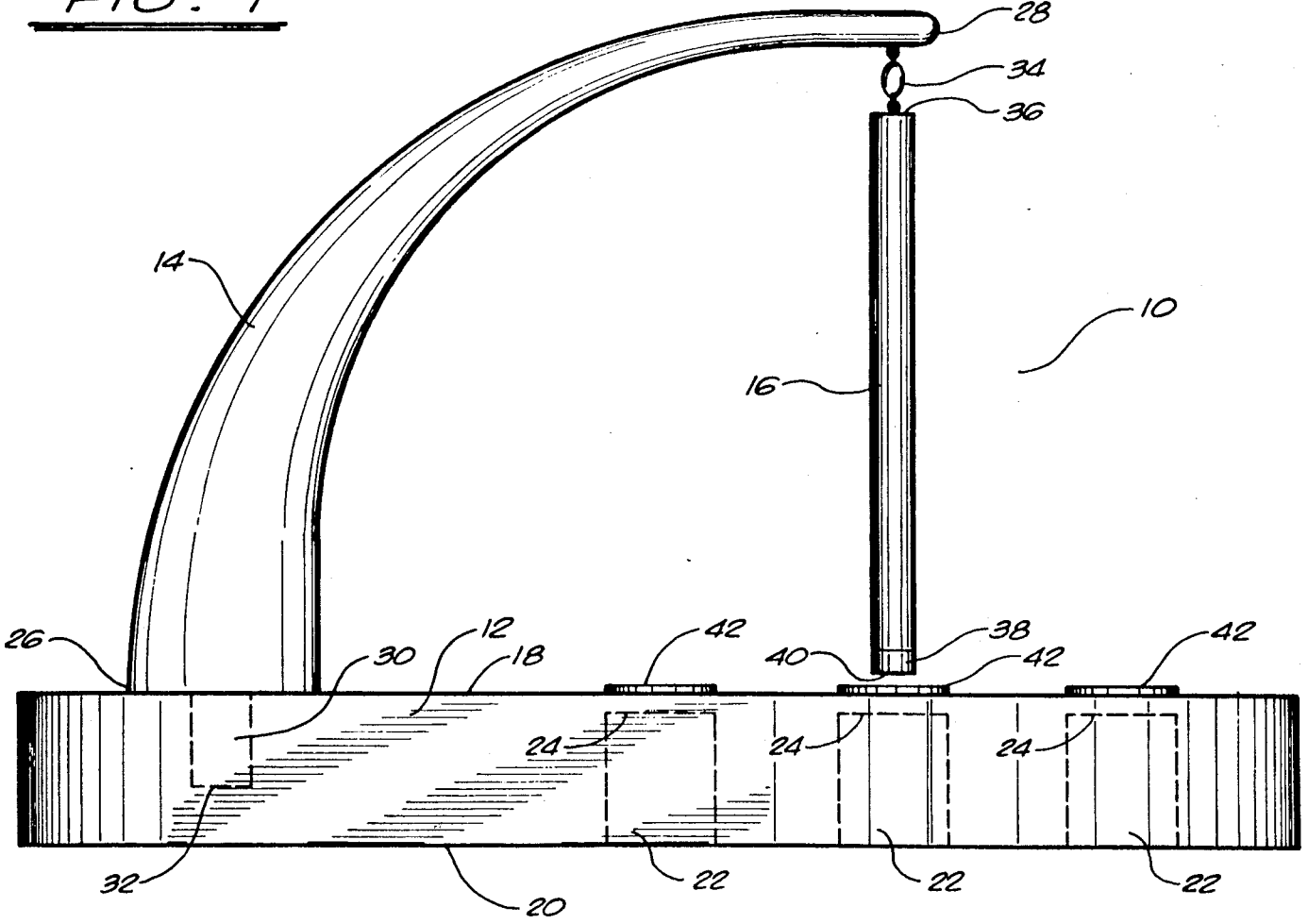
FIG. 1 is a view, in side elevation, of the apparatus in accordance with the preferred embodiment of the present invention.

Referring to FIG. 1, there is shown at 10 the indicator device in accordance with the preferred embodiment of the present invention. Indicator device 10 comprises a base 12, an arm 14, and an indicator rod 16.

In the preferred embodiment of the present invention, the base 12 is made of wood or other non-magnetic material. The base 12 includes an upper surface 18 and a bottom surface 20. The bottom surface 20 is suitable for allowing the device 10 to be placed on any flat surface. The base 12 has a plurality of magnetic members 22 attached thereto. These magnetic members 22 are placed in holes in the interior of the base 12. Each of the magnetic members 22 has a cylindrical shape. Specifically, the magnetic members 22 are inserted through openings in the bottom surface 20 of base 12. Magnetic members 22 have an identical magnetic polarity positioned at end 24 adjacent to the upper surface 18 of base 12. The opposite magnetic pole is located adjacent to the bottom surface 20 of base 12. In the preferred embodiment of the present invention, it is important that the magnetic members 22 have the same magnetic pole adjacent to the top surface 18 of base 12. So as to accommodate the magnetic flux, the top surface 24 of magnetic members 22 is separated from the upper surface 18 of base 12 by a distance of approximately one-eighth of an inch. Also, aesthetically, the configuration of the magnetic members 22 cannot be seen from above the device 10. As such, the present apparatus presents a more pleasing appearance to the user and the movement of the arm appears to be more mysterious.

Arm 14 is removably fastened to base 12. Arm 14, as illustrated in FIG. 1, has an arcuate configuration which extends from end 26 at the top surface 18 of base 12 to the end 28 generally above the arrangement of the plurality of magnetic members. As can be seen in dotted line fashion in FIG. 1, end 26 of arm 14 is fastened by rod 30 within a hole 32 in base 12. As such, the arm 14 can be assembled, as needed, for operation, or removed, as desired, for storage and shipment.

The end 28 of arm 14 is positioned generally above the configuration of the magnetic members 22. The indicator rod 16 is articulated to the end 28 of arm 14 so as to allow complete freedom of movement for the indicator rod 16. To accommodate this articulation requirement, a ball joint 34 is attached to the arm 14 and to the end 36 of indicator rod 16. As used in the present invention, the ball joint 34 is a mechanism similar to that used on fishing lures. Although a ball joint 34 is specified, in the preferred embodiment, it should be kept in mind that a variety of other articulating mechanisms can be used so as to properly connected the indicator rod 16 to the end 28 of arm 14. For example, a hook-and-loop arrangement could be used.

The indicator rod 16 is a rigid rod that extends downwardly from the end 28 of arm 14. Rod 16 has a tubular shape and is generally inflexible along its length. A magnet 38 is fastened to the end of rod 16 opposite the ball joint 34. Magnet 38 may be attached to the rod 16 by adhesion or other means. The indicator rod 16 is typically known as a dowel rod. The magnet 38 has a relatively strong magnetic strength in relation to the magnetic members 22. The magnet 38 should have the opposite polarity at end 40 than the magnetic members 22 at end 24. In this arrangement, the magnet 38 will properly be attracted to and interact with the magnetic members 22.

So as to assist in the decision making process, a plurality of indicator pads 42 are affixed to the top surface 18 of base 12. As can be seen, the indicator pads 42 are placed in proximity to the magnetic members 22. These indicator pads 42 can have decision making indicia printed thereon or can have number information printed thereon. As can be seen, the indicator pads 42 are in close proximity to the end 40 of magnet 38. During the operation of the present invention, the indicator rod 16 will move angularly with respect to one of the indicator pads 42 and the aligned, adjacent magnetic members 22. The indicator pads 42 may be adhesively fastened to the top surface 18 of base 12.

Figure 2:
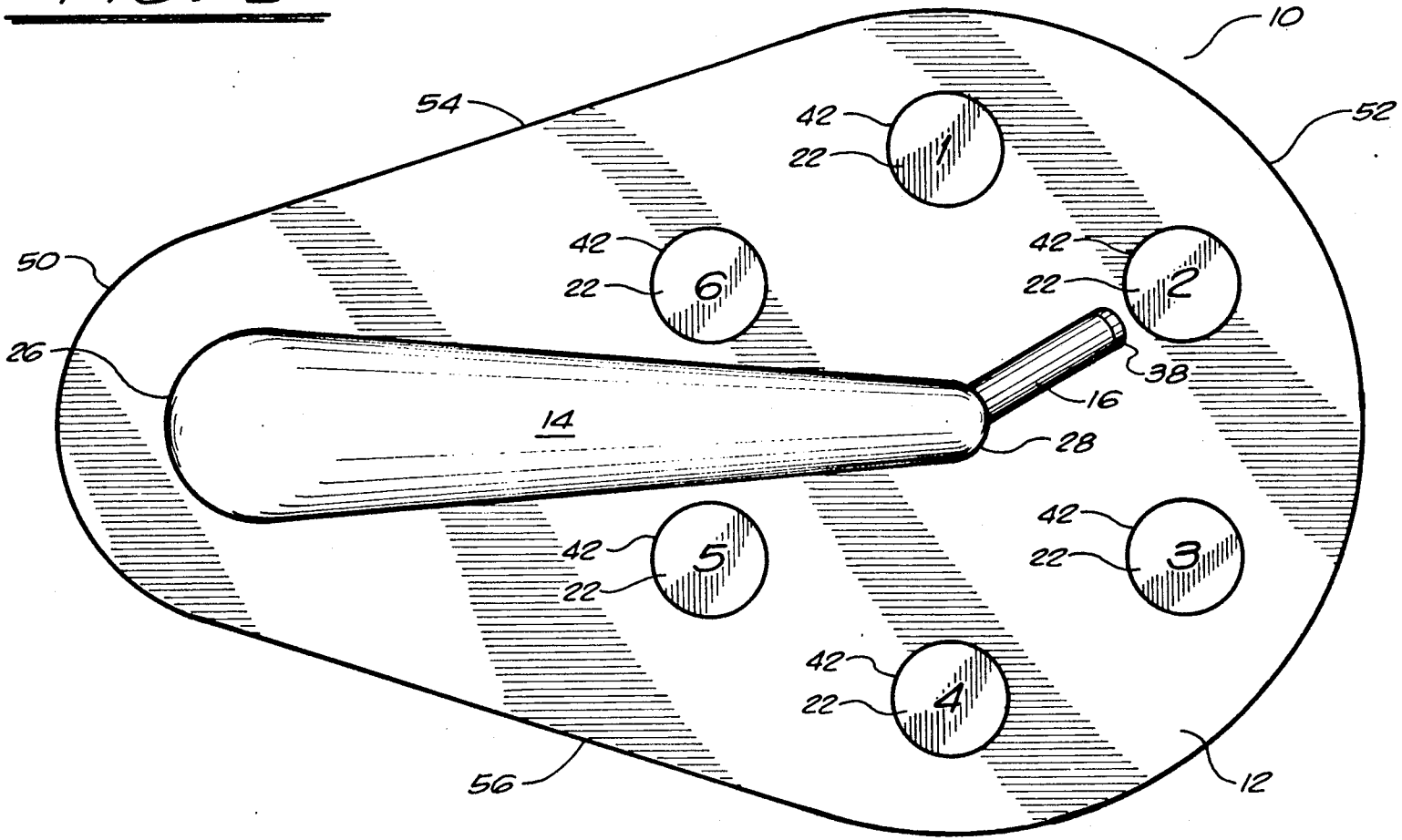
FIG. 2 is a top view of the apparatus of the present invention showing, in particular, the operation of the present invention.

FIG. 2 shows a top view of the indicator apparatus 10. The view of FIG. 2 assists in showing the operation of the apparatus 10.

The base 12 has a first circular end 50 and a second circular end 52. Straight sides 54 and 56 connect the first end 50 to the second end 52. The configuration of the shape of the base 12 is merely chosen for aesthetics. Many designs of the shape of base 12 could be selected and would be appropriate. The shape of base 12 is not considered to be a limitation of the present invention.

As can be seen, each of the magnetic members 22 are illustrated as having an indicator pad 42 positioned thereover. In the embodiment illustrated in FIG. 2, the indicator pads 42 are marked with numbers from one to six. In the embodiment illustrated in FIG. 2, the indicator device 10 is suitable for functioning as a substitute die. In essence, the apparatus 10 functions so as to randomly select numbers between one and six. As used herein, the term "indicator pad" can include the formation of numbers, words, or phrases onto the surface 18 of base 12.

Each of the indicator pads 42 has a shape generally matching the shape of a magnetic member beneath the indicator pad. It can be seen that the magnetic members 22 are arranged in a generally circular pattern within base 12. As used herein, the circular pattern is used in its general sense. It can be seen that each of the magnetic members 22 has a center point that is of equal radius from the center point of the configuration as is the radius to all other magnetic members. It can also be seen that each of the magnetic members 22 is spaced an equal distance from an adjacent magnetic member. The configuration and arrangement of the magnetic members is necessary so as to enhance the randomizing of the choice of numbers by the indicator rod 16.

FIG. 2 shows the magnetic members 22 as six in number. It is believed that the present invention can also function properly with five or more magnetic members 22. The essential requirement is that the members 22 be spaced equally and arranged in a rather circular pattern with respect to the center point.

The arm 14 is shown as having a generally wide end 26 which extends upwardly and outwardly to end 28. The dowel rod 16 is articulated to the end 28 of arm 14. The magnet 38 on dowel rod 16 is attracted to the magnetic forces exerted by the magnetic members 22.

In operation, the dowel rod 16 may extend vertically downwardly in the position illustrated in FIG. 1. Whenever a force is applied to the body of the dowel rod 16, the magnetic interaction between the magnet 38 and that of the magnetic members 22 will cause the dowel rod 16 to move randomly and chaotically. It is believed that this movement of the dowel rod 16 is enhanced by the interaction of the magnetic fluxes of the magnetic members 22 with that of the magnet flux of magnet 38. Each of the magnetic members 22 has an overlapping magnetic flux that causes the random movement of the dowel rod 16 between each of the magnetic members 22. Whenever enough force is applied to the body of dowel rod 16 so as to bring the magnet 38 within the magnetic flux of one of the magnetic members, then a great deal of movement is generated in the dowel rod. Ultimately, after a great deal of movement, the dowel rod 16 will reach an equilibrium point in which the magnet 38 is attracted to a specific magnetic member 22. This equilibrium point is the steady indicator position.

In the present invention, it is important that the indicator rod 16 be a rigid member. It is believed that a tether or a string will reduce the amount of movement prior to reaching the equilibrium state. Also, the dowel rod 16 manages to always maintain the magnet 38 at a constant distance from the end 28 (the articulation point) of arm 14. The maintenance of this constant distance contributes to the random movement of the magnet 38.

As a random number generator, the present invention has several requirements. First, it is important that each of the magnetic members 22 be placed in a circular pattern and be placed an equal distance from the center point. It is also necessary that each of the magnetic members 22 generate an equal amount of magnetic flux. Furthermore, it is important that the dowel rod 16 maintain the magnet 38 an equal and constant distance from the end of arm 28. When these requirements are met, the present invention can serve as a replacement for a die so as to cause an equal chance of occurrence between each of the indicator pads 42.

Although FIG. 2 shows the numbers from one to six as the markings on indicator pads 42, it is believed a wide variety of decision making statements could also be used. For example, words such as "yes", "no", "maybe", "probably", "probably not", or "uncertain", could be used. Alternatively, the present invention could be an amusement decision making device by using words such as "go fishing", "repair home", "mow lawn", "relax", or "watch T.V.". The present invention makes itself available for a wide variety of such variations.

Figure 3:
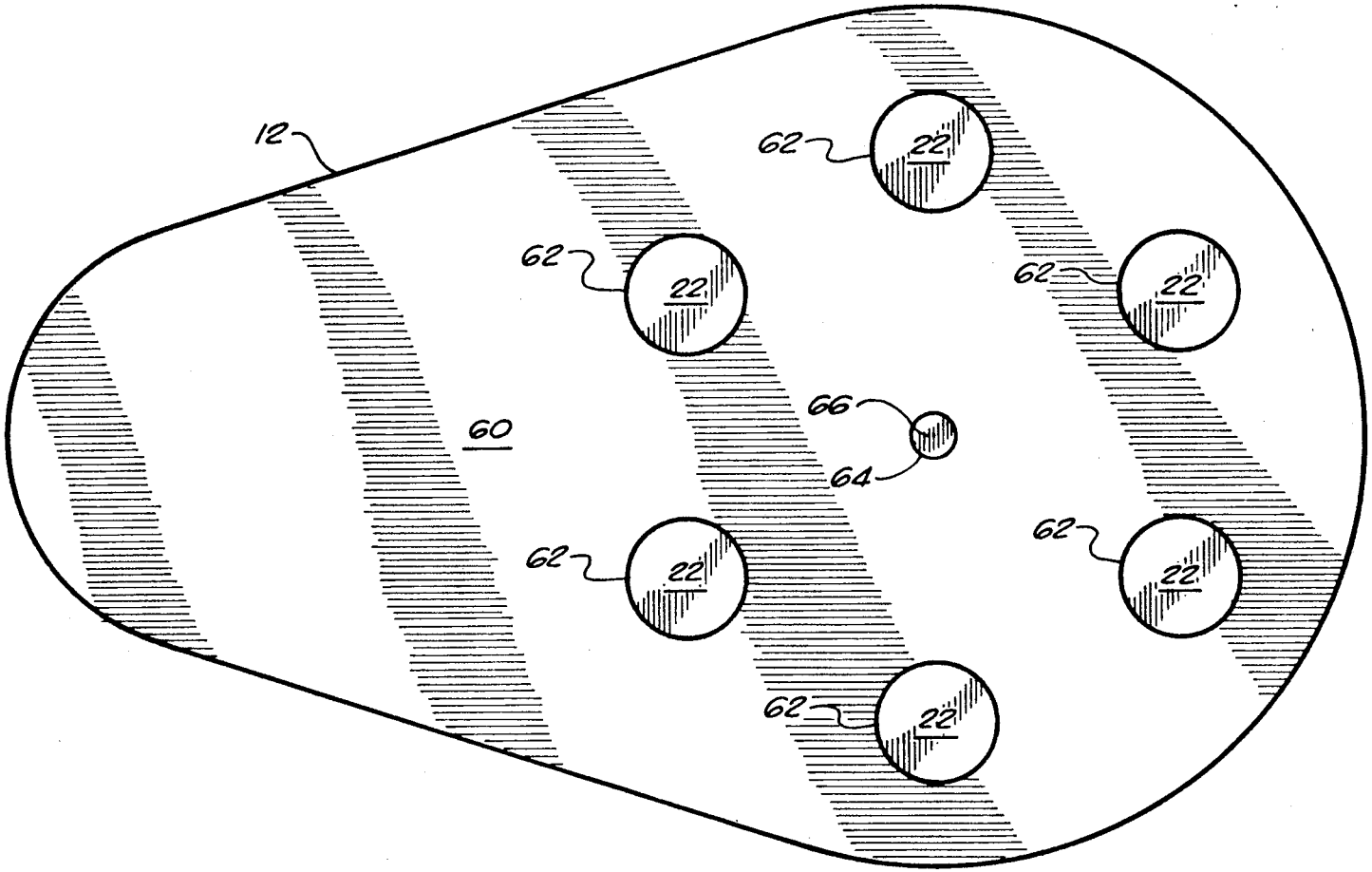
FIG. 3 is a bottom view of an alternative embodiment of the apparatus of the present invention.

FIG. 3 illustrates an alternative embodiment of the present invention. FIG. 3 illustrates the bottom 60 of the base 12 of the present invention. As can be seen, there are a number of holes 62 which are formed in the bottom 60 of base 12. Each of the holes 62 serves to accommodate a separate magnetic member 22. As can be seen, the configuration of the magnetic member 22 matches the configuration of the magnetic members 22 of FIG. 2. The forming of the hole 62 allows for the simple insertion of the magnetic members 22 into their desired locations.

Of particular significance in FIG. 3 is the forming of a hole 64 so as to accommodate a magnet 66. The magnet 66 has a polarity that is the reverse of the polarity of the magnets 22. As such, if the magnets 22 have a north pole located adjacent to the top surface 18 of base 12, then the magnet 66 will have a south pole adjacent such top surface. Alternatively, if each of the magnetic members 22 has a south pole adjacent to the top surface 18 of base 12, then the magnet 66 will have a north pole adjacent to such top surface. In such arrangement, the polarity of the magnet 66 will repel the magnet 38 on the end of indicator rod 16. After experimentation, it was found that the introduction of this repulsive magnet 66, in the manner illustrated in FIG. 3, will generate much more action by the indicator rod 16 prior to reaching the equilibrium (or indicator) position. Since it is considered desirable to have a great deal of action in the rod 16, the inclusion of the repulsive magnet 66 makes the indicator apparatus 10 a more desirable toy.

The present invention has a great deal of value as an amusement device. It offers itself as an alternative to the use of a standard die in any board games. It makes for an attractive alternative for inclusion in any game requiring the use of a die, or other decision making apparatus. The present invention, in the preferred embodiment, is made of a wooden material. However, the present invention may also be made of plastic, or other non-magnetic material, so as to accommodate the purposes of the present invention. For example, plastic material may be cheaper to manufacture in large quantities for the purpose of including in a board game.

The wild, chaotic motion of the dowel rod makes for a very compelling apparatus. It is an unusual sight to see the wild movement of the dowel rod prior to its settling into an equilibrium position. It is virtually impossible to predict, at any time, what position the dowel rod will eventually take during its wild chaotic motion. Although the dowel rod is stable in its equilibrium position, it is also very easy to move so as to start its motion in progress. A gentle nudge on the side of the dowel rod with one's fingers can cause this motion to occur.

The foregoing disclosure and description of the invention is illustrative and explanatory thereof. Various changes in the details of the illustrated construction may be made within the scope of the appended claims without departing from the true spirit of the invention. The present invention should be limited by the following claims and their legal equivalents.

I claim:

1. An apparatus comprising:

a base having a plurality of magnetic members attached thereto;

an arm connected to said base and extending upwardly above said base;

a rigid rod articulated at one end to said arm, said rigid rod having a magnet attached at another end of said rigid rod, said magnet being interactive with said magnetic members of said base; and a plurality of indicator pads fastened to a top surface of said base, each of said indicator pads being aligned with a corresponding magnetic member within said base.

2. The apparatus of claim 1, said plurality of magnetic members arranged in a circular pattern within said base.

3. The apparatus of claim 2, each of said plurality of said magnetic members being spaced an equal distance from an adjacent magnetic member.

4. The apparatus of claim 1, each of said plurality of magnetic members having a cylindrical shape, each of said plurality of magnetic members affixed within an interior of said base.

5. The apparatus of claim 4, each of said plurality of magnetic members having a similar magnetic pole at one end, said one end being positioned adjacent an upper surface of said base.

6. The apparatus of claim 5, said one end being positioned approximately one-eighth of an inch below said upper surface of said base.

7. The apparatus of claim 1, said base having a plurality of magnetic members positioned in a circular pattern within said base, each of said plurality of magnetic members being separated from an adjacent magnetic member by an equal distance, each of said plurality of magnetic members extending upwardly within said base such that a common magnetic pole is adjacent to an upper surface of said base.

8. The apparatus of claim 7, further comprising:

a reverse polarity magnetic member fastened within said base at a center of said circular pattern of said plurality of magnetic members.

9. The apparatus of claim 7, said plurality of magnetic members comprising six magnetic members.

10. The apparatus of claim 1, said arm having one end removably fastened to said base, said rigid rod being articulated to another end of said arm, said another end of said arm positioned generally above said plurality of magnetic members in said base.

11. The apparatus of claim 1, said rigid rod comprising a dowel rod connected to a ball joint at one end, said ball joint connected to said arm, said rigid rod extending downwardly from said arm.

12. The apparatus of claim 11, said magnet affixed to another end of said dowel rod, said magnet interposed between said plurality of magnetic members and said dowel rod, said plurality of magnetic members having a common magnetic polarity at one end, said magnet having a polarity opposite said common magnetic polarity of said plurality of magnetic members.

13. An apparatus comprising:

a base;

a plurality of magnetic members fastened in a circular pattern to said base, each of said magnetic members having a similar magnetic pole adjacent to a top surface of said base;

an arm connected to said base, said arm having a portion above said plurality of magnetic members;

a magnet suspended from said portion of said arm so as to be magnetically interactive with said plurality of magnetic members; and a plurality of indicator pads fastened to said top surface of said base in a position corresponding to said plurality of magnetic members.

14. The apparatus of claim 13, further comprising:

a central magnetic member fastened to said base, said central magnetic member positioned central of said circular pattern of said magnetic members, said central magnetic member having an opposite magnetic polarity than said polarity of said plurality of magnetic members.

15. The apparatus of claim 13, further comprising:

a dowel rod articulated at one end to said portion of said arm, said magnet affixed to another end of said dowel rod, said magnet having a polarity opposite to said similar magnetic pole of said plurality of magnetic members.

16. The apparatus of claim 15, further comprising:

a ball joint connected to said dowel rod and to said portion of said arm.

* * * * *